US006637084B2

(12) United States Patent
Dischler

(10) Patent No.: US 6,637,084 B2
(45) Date of Patent: Oct. 28, 2003

(54) ABRADED HIGH FILL STRENGTH FABRICS SUBSTANTIALLY FREE FROM DISCOLORATION STREAKS

(75) Inventor: Louis Dischler, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/099,421

(22) Filed: Mar. 15, 2002

(65) Prior Publication Data

US 2002/0092143 A1 Jul. 18, 2002

Related U.S. Application Data

(63) Continuation of application No. 09/632,555, filed on Aug. 4, 2000, now Pat. No. 6,363,592, which is a continuation of application No. 09/363,507, filed on Jul. 29, 1999, now Pat. No. 6,242,370, which is a continuation of application No. 09/045,094, filed on Mar. 20, 1998, now Pat. No. 5,943,745.

(51) Int. Cl.[7] ..... D06C 19/00
(52) U.S. Cl. ..... 26/28; 28/163; 442/181
(58) Field of Search ..... 26/28, 27, 99, 26/101, 104, 87, 51, 51.3, 29 R, 32, 37, 71, 77, 69 R, 69 B, 69 C; 28/140, 151, 162, 163, 170, 165; 442/181, 189, 190, FOR 101; 428/85, 90, 91; 451/28, 177, 178, 179, 241

(56) References Cited

U.S. PATENT DOCUMENTS

| | | | | | |
|---|---|---|---|---|---|
| 4,012,815 | A | * | 3/1977 | Benzaquen | 26/28 |
| 4,468,844 | A | * | 9/1984 | Otto | 26/28 |
| 4,765,100 | A | * | 8/1988 | Majors | 451/32 |
| 4,918,795 | A | | 4/1990 | Dischler | 26/1 |
| 4,947,528 | A | | 8/1990 | Dischler | 26/2 |
| 5,058,329 | A | | 10/1991 | Love et al. | 51/323 |
| 5,109,630 | A | | 5/1992 | Love et al. | 51/74 |
| 5,205,140 | A | | 4/1993 | Nielsen et al. | 66/147 |
| 5,218,747 | A | | 6/1993 | Riedel | 26/28 |
| 5,752,300 | A | | 5/1998 | Dischler | 26/28 |
| 5,815,896 | A | | 10/1998 | Dischler | 26/28 |
| 5,943,745 | A | | 8/1999 | Dischler | 26/28 |
| 6,242,370 | B1 | | 6/2001 | Dischler | 442/181 |
| 6,363,592 | B1 | | 4/2002 | Dischler | 26/28 |

* cited by examiner

*Primary Examiner*—A. Vanatta
(74) *Attorney, Agent, or Firm*—Terry T. Moyer; William S. Parks

(57) ABSTRACT

A process for angularly sueding a textile web containing fill and warp yarns with the steps of: supplying the web, controlling the tension of the web, engaging the web with at least one diamond-coated abrasive treatment roll disposed at an abrasion angle, rotating the treatment roll at a surface speed different from that of the web, and taking up the supplied web. A preferred embodiment comprises a pair of spaced treatment rolls disposed at an abrasion angle, and rotating in opposite directions relative to the web. The related apparatus for this specific process is also provided.

1 Claim, 3 Drawing Sheets

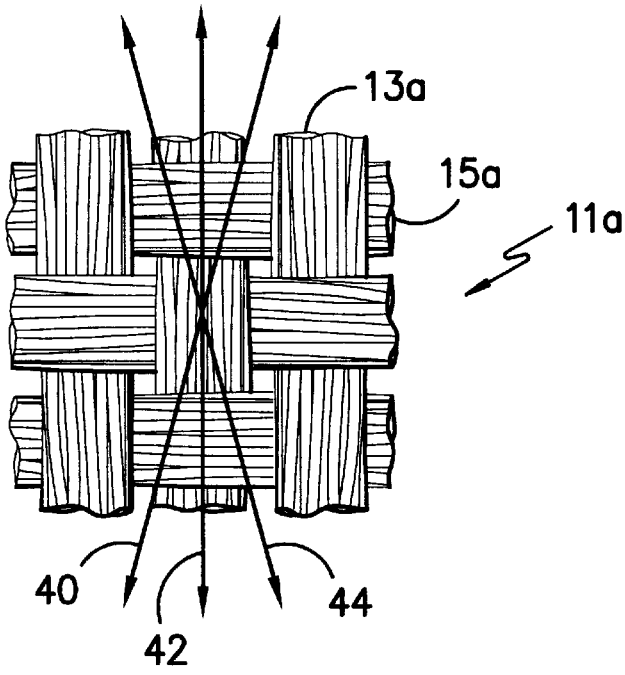
FIG. –1A–
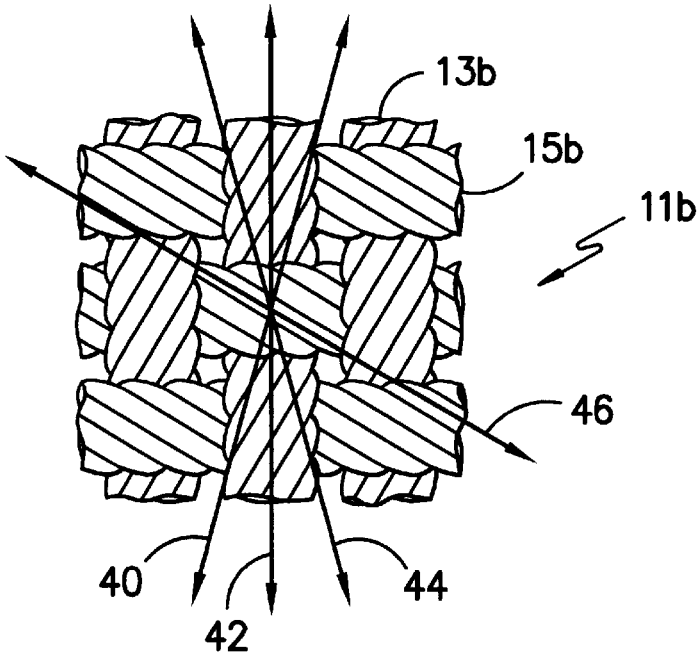
FIG. –1B–

ABRADED HIGH FILL STRENGTH FABRICS SUBSTANTIALLY FREE FROM DISCOLORATION STREAKS

CROSS REFERENCE TO RELATED APPLICATIONS

This application is a continuation of application Ser. No. 09/632,555, filed on Aug. 4, 2000, now U.S. Pat. No. 6,363,592, which is a continuation of patented application Ser. No. 09/363,507, filed on Jul. 29, 1999, now U.S. Pat. No. 6,242,370, which is a continuation of patented application Ser. No. 09/045,094, filed on Mar. 20, 1998, now U.S. Pat. No. 5,943,745.

FIELD OF THE INVENTION

This invention relates generally to the field of face finishing, and more particularly to a process and apparatus for angularly sueding a textile web containing fill and warp yarns. More specifically, the invention concerns a method of angularly abrading a textile web in order to produce effective and improved sueding within the web and decrease the potential for noticeable defects within the resultant textile. An apparatus for producing such effects is also provided.

BACKGROUND OF THE INVENTION

There are several types of spun yarns commonly used in the construction of woven fabrics. Among the most common, and familiar to those versed in the art, are ring spun, open-end spun (OES), air-jet spun (AJS), and roller jet spun (RJS) yarns. Ring spun yarns consist of generally helically wound fibers which, when woven into fabrics, exhibit excellent hand and fabric containing them becomes stiffer and harsher, as increased twist reduces fiber-to-fiber mobility. OE yarns, compared to ring spun yarns, are more disorganized and have a lower twist. The fiber bundle comprising the yarn is compacted by the presence of tightly wound wrapper fibers, which are nearly perpendicular to the axis of the yarn. As the yarn structure of OE yarns is less organized than that of ring spun yarns, the OE yarn exhibits a larger diameter than that of a ring spun of an equivalent denier. The larger size of the OE yarn, coupled with the lack of mobility of the fibers, because of the pressure imparted by the wrapper fibers, results in a stiffer fabric, in spite of the lower twist as compared to ring spun yarns. The tightly wound wrapper fibers also cause the surface of the fabric to be harsh and scratchy to the touch. The relative fiber immobility makes it difficult to enhance the fabric by needling with hydraulic jets, as these yarns cannot easily blossom when constricted by the wrapper fibers. In the same way, wrapper fibers reduce the effectiveness of pneumatic vibratory softening as disclosed in my U.S. Pat. No. 4,918,795, entirely incorporated herein by reference. As the wrapper fibers are not aligned with the axis of the yarn, they do not contribute to fabric strength, and fabrics constructed of yarns containing wrapper fibers are generally not as strong as fabrics constructed of ring spun yarns. AJS and RJS yarns are similar to OE yarns, but have core fibers with little or no twist, and the integrity of the yarn entirely depends upon the presence of the wrapper fibers. Without the fiber-to-fiber friction created by the pressure exerted by the wrapper fibers, the yarn would have no tenacity and could not be woven into fabrics. Once a fabric has been woven, yarn-to-yarn pressures are sufficient to create frictional forces between fibers, and the wrapper fibers are no longer necessary for strength. Loosening or cutting wrapper fibers, by various means such as by sanding or napping, so as to improve the hand and other properties, without substantial cutting of the load bearing fibers, can dramatically improve the hand and surface touch of the fabric, allow the fabric to blossom when hydraulically needled or to soften when pneumatically vibrated, as well as improve adhesion to coatings, without degrading fabric strength. Other methods of sanding and abrading textile fabrics are known, such as that disclosed in U.S. Pat. No. 5,058,329, to Love et al., entirely incorporated herein by reference, however they are not effective in severing or sufficiently loosening the wrapper fibers within the fabric in order to create significant associated benefits resulting therefrom without also cutting load bearing fibers and substantially reducing the strength of the fabric.

While it is possible to cut the non-load bearing wrapper fibers in the yarns without substantially reducing the fabric tensile properties, as is disclosed in my U.S. patent applications Ser. No. 08/738,787 and 08/995,184, both entirely incorporated herein by reference, it is often desirable to achieve a sueded finish by means of various types of surface abrasion, wherein load bearing fibers are also cut. However, several problems may result from such a process.

One problem associated with such surface abrasion of textile webs is the possibility of producing streaks within the resultant fabric. These are relatively lighter or darker lines that appear in the warp direction. While these may be due to fabric or yarn irregularities, they may also occur due to random variation in the grit particles. If a particularly large or aggressive particle is present, more fibers will be cut, and lighter colored fibers in the yarn core may be exposed, producing a streak. One method of mollifying the effect of individual grit particles is to make the abrasive drum very large so that the effect of a single grit particle is not continuous. However this method reduces the pressure of the fabric against the treatment roll, requiring either relatively coarse grit, or some other means to create pressure, such as through the utilization of flaps, backup rolls, or air pressure. Another method is to make the streak more difficult to observe by oscillating the treatment rolls along the rotational axis, creating a sinusoidal pattern on the fabric, so that the effect of single grit particles spread out. Oscillation is often used in multi-roll treatment machines, with the oscillations timed so as not to be superimposed.

Another common problem with all abrasive processes is that the cutting of fibers reduces the tensile properties of the fabric, regardless of yarn type. Also, except in the case of warp-faced fabrics, there is more interaction of the abrasive particles with the fibers of the fill yarns, since these fibers are more perpendicular to the movement of the abrasive particles as compared to the fibers of the warp yarns. This interaction results in relatively greater abrasion and strength degradation to the fill yarns, and may result in the shifting of fill yarns relative to warp yarns in the fabric. Compounding this problem is that, for reasons of weaving economy, many fabrics are more lightly constructed in the fill direction and therefore are initially weaker in that direction. Fibers of warp yarns, in particular filament yarns, are more difficult to cut where there is a parallel orientation of the abrasive particles and the filaments. Thus, a method of abrasively treating a web so as to retain fill strength while also avoiding a streaky appearance is needed. The present invention solves these problems in a manner not disclosed in the known prior art while producing a textile potentially having fewer noticeable defects than by other heretofore employed methods.

SUMMARY AND OBJECTS OF THE INVENTION

A method and apparatus for providing improved and efficient sueding and sanding of fill and warp yarns through loosening, cutting, and abrading a web of textile fabric is contemplated within this invention. The textile fabric web is directed under tension around at least one pair of rotatable tubes (rolls) (approximately from two to twenty-four inches in diameter) coated with abrasive particles bonded directly to the roll face and disposed at an abrasion angle. The rotational axis of a roll is parallel to the plane of the web, while the abrasion angle is 90 degrees minus the counter-clockwise angle that a tube axis makes relative to the direction of web travel. If a roll axis is oriented in the traditional sueding direction, perpendicular to the web direction, then the abrasion angle is 0 degrees. The preferred abrasion angle for angular sueding ranges from about 5 degrees to about 60 degrees and more preferably from about 10 degrees to about 45 degrees. Preferably, rolls are used in pairs with each tube of a pair position at the same abrasion angle. The abrasion angle may be positive or negative, and there may be more than one abrasion angle if multiple pairs are employed. The abrasion angle is different from the wrap angle, which is here used in the traditional sense to refer to the included angle of contact between the web and the roll. Preferred wrap angles range from 1 degree to 45 degrees, and preferably from about 2 degrees to 30 degrees.

The rolls are paired wherein one is a regressive roll and the other a progressive roll. By regressive it is meant that the roll has a rotational component in a direction opposite that of the direction of web travel, which tends to increase the subsequent tension of the web. By progressive, it is meant that the roll has a rotational component in the same direction as direction of web travel, with a surface speed faster than the web speed, which tends to decrease the subsequent tension of the web. The tension of the textile fabric web should exceed two (2) pounds per linear inch of web width (p.l.i.).

Therefore, the primary object of the invention is to provide a more balanced abrasive treatment of warp and fill yarns. Another object of the invention is to provide a higher level of sueding with the same retained fill tensile and tear properties. A further object of the invention is to provide a method of cutting the fibers of filament warp yarns. Yet another object of the invention is to provide an apparatus for angularly sueding a web. Still a further object of the invention is to provide a method of sueding that is inherently free of streaks. An additional object of the invention is to provide a method of sueding fabrics which are sensitive to shifting of the fill yarns.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The above as well as other objects of the invention will become more apparent from the following detailed description of the preferred embodiment of the invention, when taken together with the accompanying drawings in which:

FIG. 1A is a plane view of a section of the fabric web containing filament yarns to be treated.

FIG. 1B is a plane view of a section of the fabric web containing filament yarns to be treated.

DETAILED DESCRIPTION OF THE DRAWINGS AND THE PREFERRED EMBODIMENT

The drawings constitute a part of this specification and include exemplary embodiments to the invention, which may be embodied in various forms. It is to be understood that in some instances various aspects of the invention may be shown exaggerated or enlarged to facilitate an understanding of the invention. Specific details disclosed herein are not to be interpreted as limiting, but rather as a basis for the claims and as a representative basis for teaching one skilled in the art to employ the present invention in virtually any appropriately detailed system, structure or manner.

Figure 2:
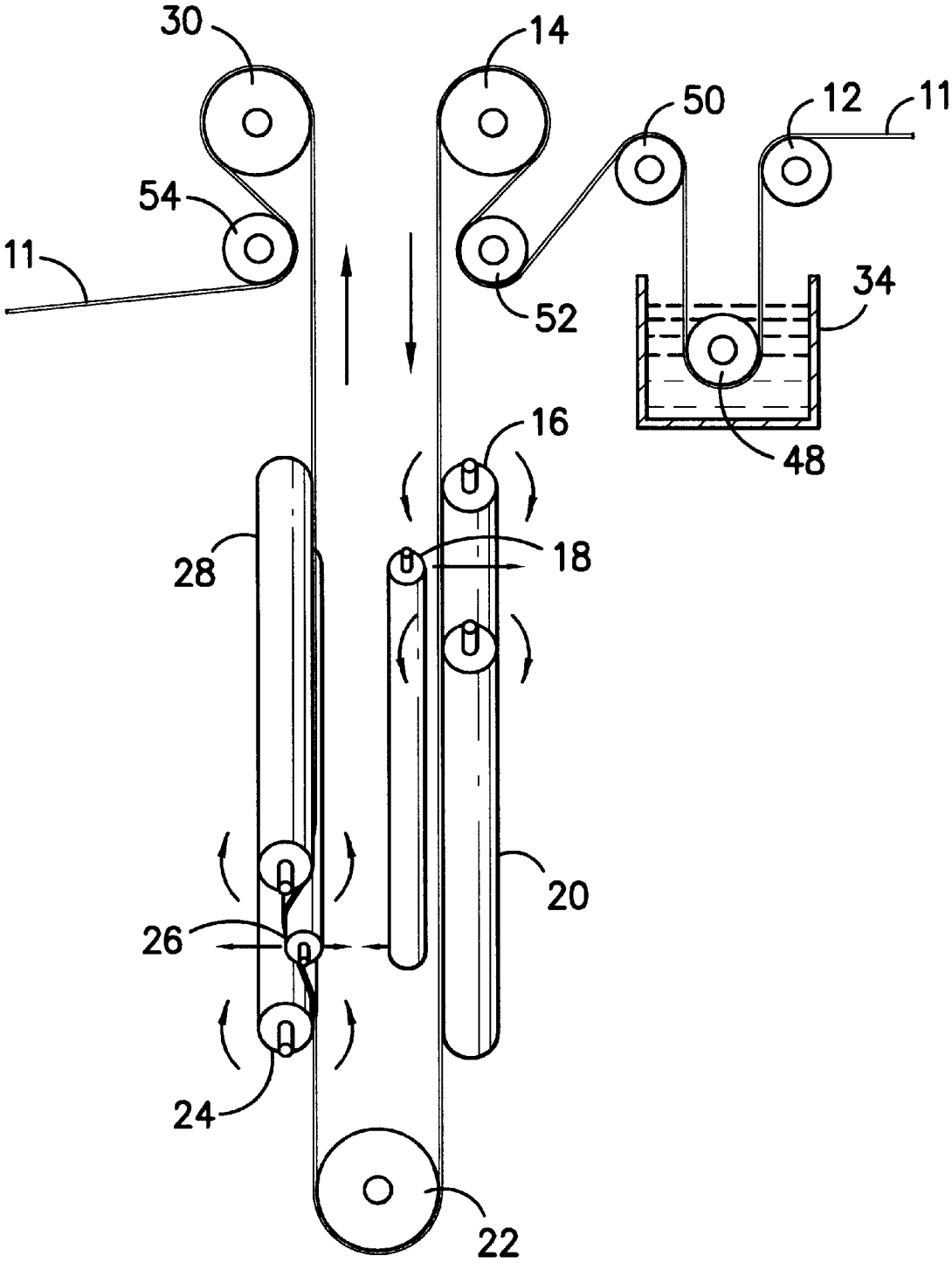
FIG. 2 is a right side view of a preferred embodiment of the invention shown in FIG. 3.

Turning now to FIG. 1A, the direction 42 is oriented with the filament warp yarns 13*a* of the fabric web 11*a*, while the filament fill yarns 15*a* are perpendicular to this direction. When the web 11*a* passes over treatment rolls (such as rolls 16, 20, 24, and 28 as shown in FIG. 2) particles of abrasive grit (not illustrated) are brought into contact with the fabric 11*a* in a selectable direction, herein called the abrasion direction. The abrasion direction is bi-directional, depending upon the rotational sense of the treatment rolls. If the fabric is abraded in the direction 42, with the rolls turning in the same direction as the fabric and at a higher speed, then the abrasion direction is 0 degrees. If the same rolls turn against the fabric, then the abrasion direction is 180 degrees. If the abrasion direction is aligned with the warp yarns 13*a*, in the direction 42, fibers within the fill yarns 15*a* are preferentially cut, as these fibers are oriented perpendicular to the abrasion direction, and more easily engage the abrasive grit (not illustrated). The grit particles (not illustrated) tend to slide between fibers oriented along direction 42 without cutting. If the abrasive particles travel in the direction 40 or 44, both fill and warp fibers are cut. Since both warp and fill fibers then contribute to the surface aesthetics, the level of treatment can be reduced while maintaining the same level of perceived treatment. Thus, the retained strength of the fill yarns of the fabric is greater than when the fabric is treated in direction 42. The relative angle measured counter-clockwise from the direction 42 to the abrasion direction is herein defined as the abrasion angle, and is preferably between 5 and 60 degrees, or between −5 and −60 degrees, and most preferably from about 10 to about 45 degrees, or from about −10 to about −45 degrees. Since the abrasion direction is bi-directional, the abrasion angle plus 180 degrees defines the same direction.

In FIG. 1B, both the warp yarns 13*b* and the fill yarns 15*b* are ring spun yarns with Z-twist. Abrading the fabric in the direction 42 cuts fibers both in the fill and warp directions, but greater damage is generally done to the fill yarns in the plain woven fabric illustrated, since the helix angle of the yarns is generally less than 45 degrees. If the helix angle is 0 degrees, the yarn is either a filament yarn as shown in FIG. 1A, or one of several types of spun yarns, such as air jet spun (AJS), or roller jet spun (RJS), which have near zero twist in the bulk of the yarn fibers. Ring spun and open-end (OE) yarns exhibit a helix angle as shown in FIG. 1B, with OE yarns additionally containing wrappers fibers which do not contribute to the strength of the fabric. In the case of ring or OE yarns having Z-twist, abrading the fabric along the direction 40 actually reduces the strength of the fill yarns 15*b* to a greater degree than the same level of abrasion in the direction 42, while abrading the fabric generally in the direction 44 reduces the damage to the fill yarns. To reduce the abrasive damage to fill yarns having Z-twist to an absolute minimum, the fabric should be treated in the direction 46, which is parallel to the fibers constituting the fill yarns 15*b*. The directions used for fill yarns with S-twist mirror those directions used for fill yarns with Z-twist. So, to reduce the abrasive damage to fill yarns having S-twist, the fabric should be treated generally in the direction 40, and to reduce the fill damage to an absolute minimum, the fabric should be treated in the direction parallel to the helix angle of the fill yarns.

A 6 oz./sq. yard poplin shirting fabric was treated along directions 40 (−15 degrees), 42 (0 degrees) and 44 (15 degrees). Both the warp and fill yarns were OE yarns with Z-twist and a helix angle of approximately 30 degrees, with 65% polyester and 35% cotton fibers in an intimate blend. The web speed was 22 ypm, the web width was 60 inches, the web tension was 5 pounds per inch of web width, and the treatment roller diameters were three inches. A pair of treatment rolls was used, covered with 300 grit SiC paper. The first treatment roll was regressive, rotating against the fabric at an absolute relative surface speed of 9.3 times the speed of the fabric. The second treatment roll was progressive, rotating against the fabric at a relative surface speed of 7.3 times the speed of the fabric. In the untreated fabric, the fabric strength in the fill direction was 75 pound per inch. After abrasion in the direction 42, the strength dropped to 32 pounds per inch. Abrading the fabric in the direction 40 reduced the fill strength even further, to 30 pounds per inch. When the fabric was abraded in the direction 44, the retained fill strength was substantially higher at 42 pounds per inch. There was no perceivable difference in the aesthetics of the three treated samples.

FIG. 2 shows an apparatus for angularly sueding a textile web 11 containing warp and fill yarns comprising entry and exit means (not illustrated), tension means (not illustrated), two pairs of treatment rolls 16, 20 and 24, 28 disposed between the entry and exit means (not illustrated), and web engagement means 18 and 26 disposed between the treatment rolls 16, 20 and 24, 28 of each of said pair. The tension means (not illustrated) comprises load cells (not illustrated), which measure the tension of the textile web 11, an electronic control system (not illustrated), and the drive roll 12 and the entry drive roll 14, which actually tension the fabric. The textile web 11 is continuously fed over entry roll 12 into an optional wet-out bath contained in tray 34, around three further rollers 48, 50, 52, to entry drive roll 14 which is coated with tungsten carbide grit to provide a high friction surface. Entry drive roll 14 is driven by a motor and gearbox (not illustrated). The web 11 then travels downward through a pivotable subassembly comprising treatment rollers 16, 20 and slidable engagement roller 18, which is actuated by air cylinders (not shown). As shown, the engagement roller 18 is retracted, allowing the textile web 11 to pass treatment rolls 16, 20 without touching when it is desired to bypass the treatment zone. The fabric continues around roll 22, which is equipped with load cells (not illustrated) for monitoring the web tension. Alternatively, the roll 22 may be a weighted dancer roll.

The web 11 then enters a second subassembly comprising treatment rolls 24, 28 and engagement roll 26. This engagement roll is shown extended, so as to create a wrap angle around rolls 24, 28. All of the treatment rolls are driven by means of individual motors and drive belts (not illustrated). The treatment rolls 16, 20 and 24, 28 may be driven in any direction, however it is preferred to drive them in opposite directions, so as to balance the side loads on the web, to avoid driving the web to one side, and to reduce the chance of creating longitudinal creases in the web. The web 11 continues upward to exit drive roll 30, which is identical to the entry drive roll 14, around roll 54, and then to a web take-up (not illustrated).

Figure 3:
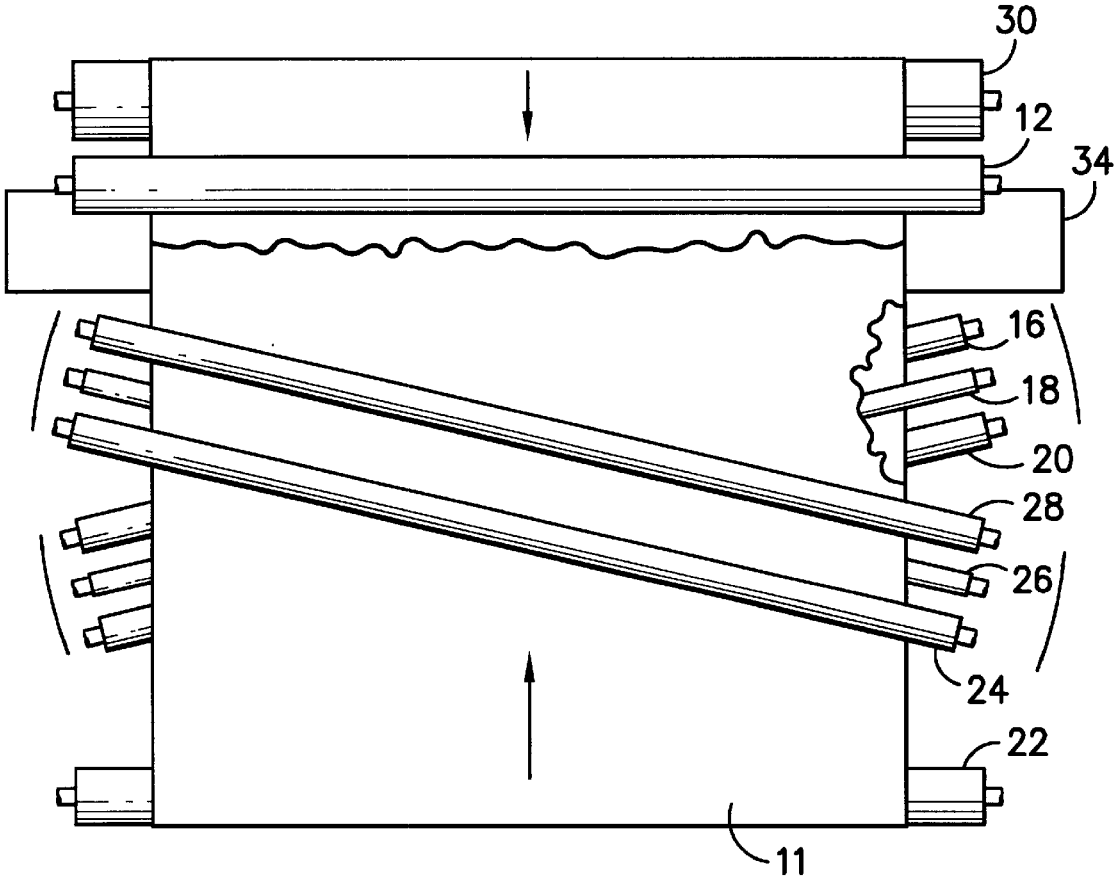
FIG. 3 is a front elevational view of a preferred embodiment of the invention.

FIG. 3 shows the orientation of the first pivotable subassembly comprising treatment rolls 16, 20 and engagement roll 18, with the second pivotable subassembly comprising treatment rolls 24, 28 and engagement roll 26, so that all treatment rolls abrade the lower face of web 11 at an angle corresponding to direction 40 of FIG. 1B, which is advantageous for a web comprising yarns with an S-twist. The two pairs of treatment rolls can also be oriented at two different angles, to provide treatment at two different abrasion directions. For instance, with one subassembly oriented to allow abrasion along angle 40, while a second is oriented to allow abrasion along direction 44, a cross abrasion of the web is obtained, particularly valuable with webs containing yarns with low or no twist. For webs containing fibers that are particularly difficult to cut, it may sometimes be useful to orient the first pivotable subassembly at a low angle, to partially cut the fibers, and then to treat at a higher angle with the next subassembly (not illustrated). More than one pass may be made, and the apparatus may be constructed with only one or a plurality of pairs of treatment rolls.

Side movement of the web during treatment is partly eliminated by the close placement of the counter-rotating treatment rolls 16, 20 and 24, 28, wherein the first roll of a pair, such as 24 and 16, is regressive, that is, having a rotation in a direction opposite the direction of the textile web 11, while the second roll of a pair, such as 28 and 20, is progressive, having a rotation in the same direction as the web 11. It is preferred that these rolls 16, 20 and 24, 28 be spaced by no more than 24 inches between the roll treatment surfaces, and it is more preferable that they be spaced by no more than 12 inches. The treatment rolls 16, 20 and 24, 28 may be wrapped with abrasive coated paper or cloth, or may be spray coated with a metal carbide grit, such as tungsten carbide, with a roughness equivalent ranging between 50 and 400 US common grit, or preferably coated with diamond grit in an electro-plated metal matrix with grit size ranging between 50 and 800 US common grit. Useful abrasion angles are typically between 5 and 60 degrees and −5 and −60 degrees, and preferably between about 10 and 45 degrees, and between about −10 and −45 degrees. Side movement is also controlled by the tension applied to the web, which should be more than 1 pound per inch of web width, and preferably more than 2 pounds per inch of web width, and less than 50% of the breaking strength of the web, considered here to be the ultimate tensile strength in the warp direction 42. It is preferred that the treatment rolls 16, 20 and 24, 28 have a diameter between 1.5 and 24 inches, and most preferably between 2 and 12 inches. The absolute value of the surface speed of the treatment rolls should be at least 1.5 times the surface speed of the textile web divided by the cosine of the abrasion angle, in order to avoid the possibility of a stick-slip engagement of the textile web 11, which would drive the fabric to the side and create creases.

Angular abrasion is inherently streak free, since the track of the abrasion caused by individual grit particles lies on the abrasion angle, and cannot overlap itself to form a noticeable streak in the warp direction 42. Also, the drag on the fill yarns by engagement with grit particles is reduced by the abrasion angle, making shifting of the fill less likely.

Angular abrasion may be advantageously employed on substrates other than those described above. For instance, the textile web may contain a filament warp combined with a spun fill, or a spun warp may be combined with a filament fill.

While woven fabrics containing warp and fill yarns have been discussed here, it is anticipated that non-woven webs containing fibers at random orientations can benefit from angular treatment, especially when cross-sueding is employed. In this case, fibers that lie primarily in the direction 42 would be cut in addition to fibers in other directions, in a similar manner to the cutting of fibers in the filament warp yarns 13*a*.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What I claim is:

1. A substantially streak-free fabric wherein said fabric has been treated through a sueding process by at least one abrasive roll exhibiting a variation in abrasive grit size on the surface of said roll, wherein said fabric exhibits a sueding treatment at an angle of at least 5 degrees and at most 60 degrees from the warp direction of said fabric, and wherein the fill strength of said fabric is greater than half the fill strength as measured for the same fabric prior to said sueding process.

* * * * *